United States Patent [19]

Larsson

[11] 4,329,855

[45] May 18, 1982

[54] HEAT PUMP

[75] Inventor: Sven A. H. Larsson, Malmö, Sweden

[73] Assignee: Industriventilation Produkt AB, Vaxjo, Sweden

[21] Appl. No.: 234,798

[22] Filed: Feb. 17, 1981

[30] Foreign Application Priority Data

Feb. 18, 1980 [SE] Sweden ..... 8001275

[51] Int. Cl.[3] ..... F25B 43/02

[52] U.S. Cl. ..... 62/473; 62/324.1; 62/509

[58] Field of Search ..... 62/473, 324.1, 509, 62/512, 513

[56] References Cited

U.S. PATENT DOCUMENTS 3,021,689 2/1962 Miller ..... 62/473 X
3,212,289 10/1965 Bottum ..... 62/509 X
3,324,671 6/1967 Harnish ..... 62/509 X
3,350,898 11/1967 Harnish ..... 62/509 X

*Primary Examiner*—Lloyd L. King
*Attorney, Agent, or Firm*—Finnegan, Henderson, Farabow, Garrett & Dunner

[57] ABSTRACT

In a heat pump with a circulation system for a refrigerant, including a compressor, a condensor, a choke member, and an evaporator, there is provided a receiver arranged as a jacket heat exchanger with a vessel connected in series between the outlet of the condensor and the choke member, and an outside jacket surrounding the vessel, connected in the return passage from the evaporator to the compressor as a liquid separator with the inlet of the return passage connected to the jacket at the bottom thereof and with the outlet of the return passage connected to the jacket at the top thereof.

2 Claims, 3 Drawing Figures

HEAT PUMP

The present invention relates to a heat pump.

The heat pump has a circulation system for a refrigerant, including a compressor, a condensor, a choke member, and an evaporator and further including a receiver comprising a vessel connected in series between the outlet of the condensor and the choke member for receiving the refrigerant leaving the condensor, the return passage from the evaporator to the compressor being arranged for heat exchange between the refrigerant passing through the receiver and the return passage, respectively.

If the flow of refrigerant to the compressor in a heat pump contains a large amount of refrigerant in liquid phase, this involves a risk of compressor breakdown and a decrease of the efficiency of the heat pump.

The primary object of the invention is to prevent refrigerant in liquid phase from reaching the compressor when the heat pump is in operation and also to adjust continuously the amount of refrigerant supplied to the evaporator such that optimum operational conditions are maintained.

According to the invention, this object is achieved by a heat pump of the type referred to above wherein the receiver is arranged as a jacket heat exchanger with an outside jacket surrounding the vessel, and wherein said jacket is connected in the return passage as a liquid separator with the inlet of the return passage connected to the jacket at the bottom thereof and with the outlet of the return passage connected to the jacket at the top thereof.

By this arrangement it is achieved that the refrigerant delivered from the evaporator, which shall be supplied to the compressor, in the outside jacket of the receiver is separated into a liquid phase received in the lower part of the jacket, and a gas phase received in the upper part of the jacket. Liquid drops, if any, which are entrained in said phase in the upper part of the jacket are rapidly heated and are evaporated by heat exchange with the hot refrigerant leaving the condensor, which is collected temporarily in the receiver vessel before it is supplied to the evaporator. An increase of the refrigerant flow to the evaporator provides an increased flow of refrigerant through the outside jacket of the receiver and thus an increased cooling of the receiver vessel, which means that the accumulation of refrigerant in liquid phase in the receiver vessel will be increased providing a decrease of the supply of refrigerant to the evaporator. By supercooling of the refrigerant in the receiver also an improvement of the cooling effect is achieved.

Figure 1:
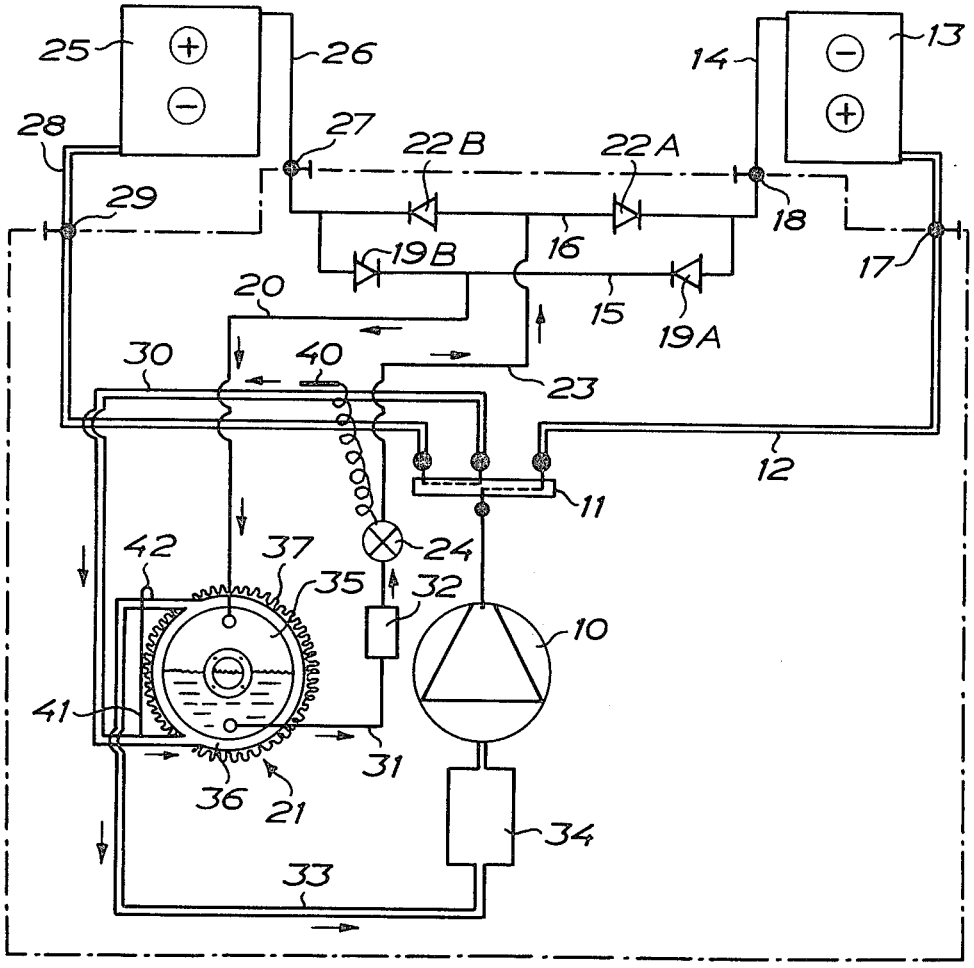
Figure 2:
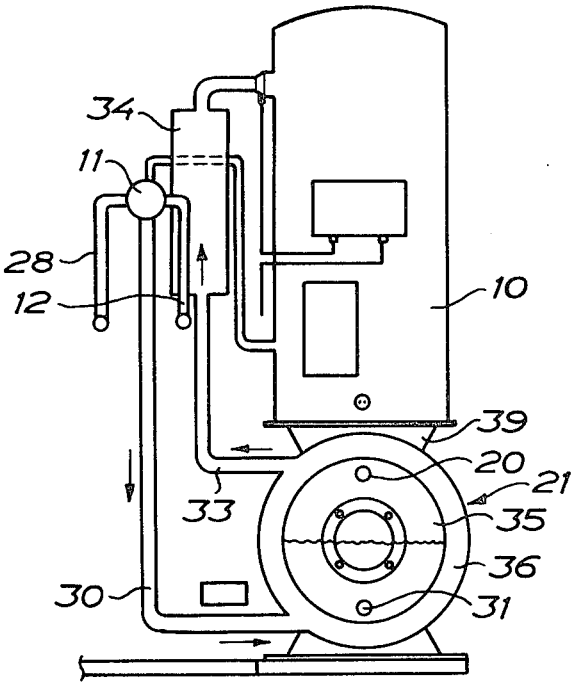
Figure 3:
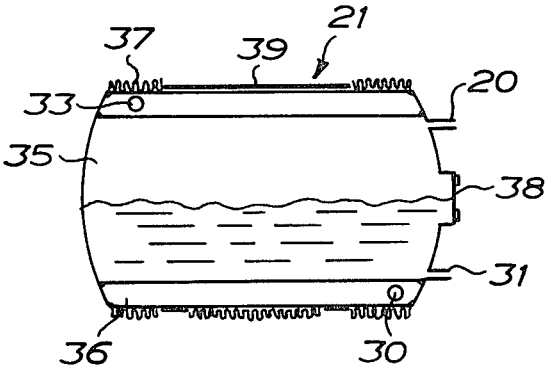

In order to illustrate the invention an embodiment thereof will be described in more detail, reference being made to the accompanying drawings in which FIG. 1 is a diagram of a heat pump according to the invention, FIG. 2 is a front view of the compressor and the receiver of the apparatus, which are built together to form a unit, and FIG. 3 is a longitudinal cross-sectional view of the receiver.

The heat pump shown in the drawings, FIG. 1, comprises a compressor 10, the pressure side of which is connected to a four-way valve 11. A conduit 12 extends from the four-way valve to a heat exchanger unit 13 which is connected by a conduit 14 to two branch conduits 15 and 16. The connection of the unit 13 to the conduit 12 and the conduit 14, respectively, is made at shut-off valves 17 and 18. In the branch conduit 15, two nonreturn valves 19A and 19B are provided and between these nonreturn valves there is connected to the conduit 15 a conduit 20 which extends to a receiver 21. The nonreturn valves 19A and 19B allow flow through the conduit 15 to the conduit 20 and block flow in the reverse direction. In the same manner there are provided in the branch conduit 16 two nonreturn valves 22A and 22B, and between these valves the conduit 16 is connected to a conduit 23 which extends from a choke member 24. The nonreturn valves 22A and 22B allow flow from the conduit 23 to and through the conduit 16 but block flow in the reverse direction.

A second heat exchanger unit 25 is connected by a conduit 26 via a shut-off valve 27 to the branch conduit 16, this unit being connected to the four-way valve 11 by a conduit 28 with a shut-off valve 29. From this valve also a conduit 30 extends to the receiver 21 which is connected by a conduit 31 via a drying filter 32 to the choke member 24 and by a conduit 33 via a dirt filter 34 to the suction side of the compressor 10.

The receiver 21 is of an embodiment which is specific to the invention and is shown in more detail in FIG. 3. It is constructed as a jacket type heat exchanger with a cylindrical vessel 35 surrounded by an outside jacket 36. On the outside of the jacket there is a heat insulation 37. The conduit 20 is connected to the vessel 35 at the top thereof in one end wall of the vessel while the conduit 31 is connected to the vessel 35 at the bottom thereof in the same end wall which has a centrally located sight glass 38. The conduit 30 is connected to the jacket 36 of the receiver 21 at the bottom thereof, while the conduit 33 is connected to the jacket at the top thereof.

The receiver 21 has at the upper side thereof a flange 39 on which the compressor 10 is mounted as shown in FIG. 2 such that the compressor and the receiver form together a unit. Also the rest of the elements of the heat pump can be included in this unit with the exception of the heat exchanger units 13 and 25, i.e. the parts of the heat pump which are located within the dash and dot line in FIG. 1. The unitary assembly thus formed can be separated from the units 13 and 25 at the valves 17, 18, 27, and 29, maintenance and repair of the heat pump being considerably facilitated thereby.

The units 13 and 25 can operate alternatively as condensors and evaporators depending on the setting of the four-way valve 11. If it is assumed that the heat pump is arranged as a climator in a room, e.g. the unit 13 can be located indoors associated with the room, and the unit 25 can be located outdoors, valves and fans being associated with each unit for circulating either air from the outside or air from the room through the units. The air from the unit 13 then is supplied to the room while the air from the unit 25 is allowed to escape to the outside. The units 13 and 25 preferably comprise ribbed units with dehumidifier grids.

The choke member 24 can comprise a capillary tube but it can also comprise an expansion valve which is preferred. This expansion valve is controlled by a thermocouple 40 which senses the temperature of the refrigerant passing through the conduit 30.

If it is assumed that the four-way valve 11 is set to maintain a connection in the manner indicated by dash lines in FIG. 1, i.e. that the pressure side of the compressor 10 is connected to the conduit 12 and the conduits 28 and 30 are connected to each other, the unit 13 will operate as a condensor and the unit 25 will operate as an evaporator in the heat pump, hot air being supplied to the room from the condensor 13.

With the setting of the four-way valve 11 which was supposed above, the compressor 10 supplies pressurized refrigerant in gas phase to the condensor 13 where the refrigerant is condensed while giving off the vaporization heat. The refrigerant in liquid phase passes through the conduit 14 and via the nonreturn valve 19A through the branch conduit 15 and the conduit 20 to the vessel 35 in the receiver 21, while said refrigerant cannot pass the nonreturn valve 22A in the branch conduit 16.

The compressor 10 generates through the conduits 33, 30, and 28 a subatmospheric pressure in the evaporator 25 such that refrigerant in liquid phase is being sucked from the vessel 35 in the receiver 21 through the conduit 31 and the drying filter 32 via the expansion valve 24 to the conduit 23 and then through the branch conduit 16 via the nonreturn valve 22B to the conduit 26 and into the evaporator 25. The refrigerant does not, however, pass through the nonreturn valve 22A, because this is kept closed by a higher pressure in the conduit 14. In the evaporator 25, the refrigerant is evaporated to the substantial part thereof while taking up the vaporization heat from the air passing through the evaporator, and the refrigerant in gas phase together with existing residues of refrigerant in liquid phase, if any, passes through the conduit 28 via the four-way valve 11 and the conduit 30 to the jacket 36 of the receiver 31. Having left the jacket 36, the refrigerant passes through the conduit 33 and the dirt filter 32 to the suction side of the compressor 10.

In the receiver 21, heat exchange takes place between the colder refrigerant in gas phase from the evaporator 25, which passes through the jacket 36, and the hotter refrigerant in liquid phase from the condensor 13, which more or less is being accumulated in the vessel 35 in the receiver before it passes on to the expansion valve 24. By the heat exchange in the receiver there is obtained in co-operation with the expansion valve 24 controlled by the temperature of the refrigerant in the conduit 30, balancing of the supply of refrigerant to the evaporator 25 such that the amount of refrigerant supplied to the evaporator is optimally adjusted in order to avoid that refrigerant in liquid phase is sucked into the compressor or an amount of refrigerant, which is too small, is supplied to the evaporator 25. Moreover, due to the supercooling of the refrigerant in liquid phase in the vessel 35 of the receiver the cooling effect obtained in the heat pump is improved.

Some lubricant oil can accompany the circulating refrigerant from the compressor and in order that this oil shall not accumulate on the bottom of the jacket 36 of the receiver 21 an oil separator is associated with the receiver. This separator comprises a choked or restricted capillary tube 41 which is connected at one end thereof to the conduit 30 where this conduit connects to the jacket 36, and extends upwards to the conduit 33 where this conduit connects to the jacket 36, the tube being connected to the conduit 33 via an oil pocket 42, a so-called P-trap. Via this oil separator the oil is sucked from the conduit 30 to the conduit 33 to pass into the compressor 10 and contributes to the lubrication thereof.

For cooling the room in which the heat pump is being used the four-way valve 11 is adjusted to such a position that the conduits 12 and 30 are interconnected while the conduit 28 is connected to the pressure side of the compressor 10. Then, the unit 25 will operate as condensor and the unit 13 as evaporator, and the nonreturn valve 19A as well as the nonreturn valve 22B will block while flow is allowed through the nonreturn valves 19B and 22A. Otherwise, the operation will be the same as that described above, as will be realized. The units can be arranged for heat exchange between air and refrigerant as in the embodiment described or between liquid and refrigerant.

I claim:

1. In a heat pump with a circulation system for a refrigerant including a compressor, a condensor, a choke member, and an evaporator, and further including a receiver comprising a vessel connected in series between the outlet of the condensor and the choke member for receiving the refrigerant leaving the condensor, the return passage from the evaporator to the compressor being arranged for heat exchange between the refrigerant passing through the receiver and the return passage, respectively, the improvement wherein the receiver is arranged as a jacket heat exchanger with an outside jacket surrounding the vessel, and wherein said jacket is connected in the return passage as a liquid separator with the inlet of the return passage connected to the jacket at the bottom thereof and with the outlet of the return passage connected to the jacket at the top thereof.

2. A heat pump as claimed in claim 1 further comprising an oil separator connected between the inlet and outlet of the return passage to transfer oil collected in the jacket, if any, from the inlet to the outlet.

* * * * *